US009691523B2

(12) United States Patent
Pourladian et al.

(10) Patent No.: US 9,691,523 B2
(45) Date of Patent: Jun. 27, 2017

(54) JACKETED TORQUE BALANCED ELECTROMECHANICAL CABLE

(71) Applicant: WireCo WorldGroup Inc., Kansas City, MO (US)

(72) Inventors: Bamdad Pourladian, Kansas City, KS (US); Elham Forouzesh, Overland Park, KS (US); Kyle Bowland, Savannah, MO (US)

(73) Assignee: WIRECO WORLDGROUP INC., Prairie Village, KS (US)

( * ) Notice: Subject to any disclaimer, the term of this patent is extended or adjusted under 35 U.S.C. 154(b) by 0 days.

(21) Appl. No.: 14/726,011

(22) Filed: May 29, 2015

(65) Prior Publication Data

US 2015/0348677 A1 Dec. 3, 2015

Related U.S. Application Data

(60) Provisional application No. 62/005,686, filed on May 30, 2014.

(51) Int. Cl.

| | |
|---|---|
| ***H01B 7/18*** | (2006.01) |
| ***H01B 7/22*** | (2006.01) |
| ***H01B 19/00*** | (2006.01) |
| ***H01B 7/04*** | (2006.01) |

(52) U.S. Cl.

CPC ..... *H01B 7/221* (2013.01); *H01B 7/046* (2013.01); *H01B 19/00* (2013.01); *Y10T 29/49229* (2015.01)

(58) Field of Classification Search

CPC ..... H01B 7/18
USPC ..... 174/106 R, 128.1
See application file for complete search history.

(56) References Cited

U.S. PATENT DOCUMENTS

| | | | |
|---|---|---|---|
| 2,604,509 | A | 7/1952 | Blanchard |
| 3,318,082 | A | 5/1967 | Riggs |
| 3,634,607 | A | 1/1972 | Coleman |
| 3,800,066 | A | 3/1974 | Whitfill, Jr. et al. |
| 4,120,145 | A | 10/1978 | Chiappetta et al. |

(Continued)

FOREIGN PATENT DOCUMENTS

WO 2013082244 A1 6/2013

OTHER PUBLICATIONS

Rochester Brand Engineered Cable Solutions for Harsh Environments, 2012, 16 pages, Tyco Electronics Corporation.

*Primary Examiner* — Chau N Nguyen
(74) *Attorney, Agent, or Firm* — Husch Blackwell LLP

(57) ABSTRACT

An electromechanical cable that is crush-resistant and torque balanced is provided as well as a method for manufacturing a crush-resistant and torque balance electromechanical cable. The cable can include a core having a conductor surrounded by a first jacket layer, a second jacket layer surrounding the first jacket layer, a first armor layer surrounding second jacket layer, a third jacket layer surrounding the first armor layer, a second armor layer surrounding the third jacket layer, and a fourth jacket layer surrounding the second armor layer. The first armor layer can be constructed as a plurality of wires and compressed partially into the second jacket layer. The second armor layer can be constructed from a plurality of three-wire strands and/or single wires and compressed partially into the third jacket layer. The three-wire strands can symmetric or asymmetric and can be compacted or non-compacted.

10 Claims, 6 Drawing Sheets

(56) References Cited

U.S. PATENT DOCUMENTS

| | | | | |
|---|---|---|---|---|
| 4,131,758 | A | 12/1978 | Felkel | |
| 4,422,286 | A | 12/1983 | Simpson et al. | |
| 4,470,249 | A | 9/1984 | Chiappetta et al. | |
| 4,490,969 | A | 1/1985 | Simpson et al. | |
| 4,606,183 | A | 8/1986 | Riggs | |
| 4,635,432 | A | 1/1987 | Wheeler | |
| 4,952,012 | A | 8/1990 | Stamnitz | |
| 5,150,443 | A * | 9/1992 | Wijnberg | E21B 17/206 174/106 R |
| 6,307,156 | B1 * | 10/2001 | Avellanet | B21C 37/045 174/128.1 |
| 6,900,391 | B1 | 5/2005 | Maeda | |
| 7,170,007 | B2 | 1/2007 | Varkey et al. | |
| 7,188,406 | B2 | 3/2007 | Varkey et al. | |
| 7,326,854 | B2 | 2/2008 | Varkey | |
| 7,402,753 | B2 | 7/2008 | Varkey et al. | |
| 7,462,781 | B2 | 12/2008 | Varkey et al. | |
| 7,586,042 | B2 | 9/2009 | Varkey et al. | |
| 7,700,880 | B2 | 4/2010 | Varkey et al. | |
| 7,793,409 | B2 | 9/2010 | Varkey | |
| 7,915,532 | B2 * | 3/2011 | Varkey | H01B 7/292 174/110 R |
| 8,418,433 | B2 | 4/2013 | Noguchi et al. | |
| 2005/0109530 | A1 | 5/2005 | Maeda | |
| 2007/0036974 | A1 | 2/2007 | Verreet | |
| 2007/0193767 | A1 * | 8/2007 | Guery | H01B 5/105 174/106 R |
| 2009/0283295 | A1 | 11/2009 | Varkey et al. | |
| 2010/0263904 | A1 | 10/2010 | Varkey et al. | |
| 2011/0147079 | A1 | 6/2011 | Dlugas | |
| 2011/0278062 | A1 | 11/2011 | Varkey | |
| 2012/0097419 | A1 | 4/2012 | Varkey et al. | |
| 2012/0163758 | A1 | 6/2012 | McCullough et al. | |
| 2012/0222869 | A1 | 9/2012 | Varkey | |
| 2013/0206314 | A1 | 8/2013 | Varkey et al. | |
| 2013/0220665 | A1 | 8/2013 | Wong et al. | |
| 2014/0041925 | A1 | 2/2014 | Davis et al. | |

* cited by examiner

JACKETED TORQUE BALANCED ELECTROMECHANICAL CABLE

CROSS-REFERENCE TO RELATED APPLICATIONS

This Application claims priority to U.S. Provisional Patent Application Ser. No. 62/005,686, filed on May 30, 2014, to Pourladian, Bamdad et al., entitled "Jacketed Torque Balanced Electromechanical Cable," currently pending, the entire disclosure of which is incorporated herein by reference.

FIELD OF THE INVENTION

The present invention relates to electromechanical cables, and in particular an electromechanical cable that is torque balanced, crush-resistant and jacketed and has particular utility for providing power to down-hole apparatuses in the extraction of subterranean natural resources.

BACKGROUND OF THE INVENTION

Electromechanical cable is commonly used to provide electricity to down-hole apparatuses in the oil and gas industry as well as numerous other subterranean activities. These types of down-hole or down-well applications normally have present elevated pressures requiring sealing of any entrance. As a result, the entrance of the electromechanical cable into the well must be sealed. Furthermore, as the cable is lowered into the well, a continuous seal must be maintained.

An existing and common method for maintaining the seal of the cable entrance is to pack the interface with grease. Grease is a petroleum product that has a detrimental effect on the surrounding environment it comes into contact with. In addition, it is difficult to remove the grease from the outer surface of an electromechanical cable when the cable is retrieved and re-wound during its introduction and removal from the oil or gas well.

It is also advantageous for such electromechanical cables to be crush-resistant so that the integrity of the seal can be maintained during use. This crush-resistance is also particularly advantageous where an electromechanical cable includes fiber optic data lines, which is common in the industry.

In addition, down-hole oil and gas wells can commonly extend thousands of feet, thus requiring an electromechanical cable capable of functioning properly while extending such a distance.

Accordingly, a need exists for an electromechanical cable needing no or little grease for use in down-hole or down-well applications. Additionally, a need exists for a crush-resistant electromechanical cable so that the cross-section remains consistent to maintain the grease-less seal and to protect the integrity of fiber optic data lines that can be incorporated into the cable. In addition, because electromechanical cables can extend thousands of feet into an oil or gas well, there is a need in the art for a torque-resistant construction, allowing for increased cable lengths.

SUMMARY OF THE INVENTION

One objective of the present invention is to provide an electromechanical cable suitable for use in subterranean environments, especially for down-well applications. Another object of the present invention is to provide an electromechanical cable that can be used in down-well applications in conjunction with a sealed cable entrance with the use of little or no grease while maintaining the integrity of the sealed entrance. Another object of the present invention is to provide an electromechanical cable suitable that is crush-resistant to maintain the integrity of a sealed entrance in down-well applications and protect fiber optic lines incorporated into the cable. Another objective of the present invention is to provide an electromechanical cable that is torque-balanced to allow for extended cable lengths commonly required in subterranean down-well applications.

The present invention generally relates to a torque balanced electromechanical cable comprising a cable core surrounded by a plurality of jacket layers and armor layers. The arrangement and configuration of the jacket layers and armor layers facilitate the creation of torque-balanced and crush-resistant properties in the cable.

According to one embodiment of the present invention, the cable core comprises a conductor surrounded by a first jacket layer made from plastic or similar wire coating materials. The conductor can be a single wire or a plurality of stranded wires. Extruded onto the cable core can be a second jacket layer made from plastic or similar coating material. A plurality of wires is wrapped around the second jacket layer to form a first armor layer having a specified lay direction. The wires are compressed partially into the second jacket layer creating a better bond between the second jacket layer and first armor layer and removing void spaces between the wires of the first armor layer. The first armor layer can then be surrounded by a third jacket layer. The third jacket layer can be an extruded plastic or similar coating material and can fill any voids existing on the exterior of the first armor layer to allow for better adhesion between the layers.

A second armor layer, having a specified lay direction, can be formed around the third jacket layer. In one embodiment of the present invention, the second armor layer comprises a plurality of 3-wire strands circumferentially spaced around the third jacket layer. In another embodiment, the second armor layer comprises a plurality of single wires circumferentially spaced around the third jacket layer. In yet another embodiment, a combination of 3-wire strands and single wires are used to construct the second armor layer. The second armor layer can be wrapped around the third jacket layer with a lay direction opposite that of the first armor layer to achieve greater torque balance of the electromechanical cable. The second armor layer can then be surrounded by a fourth jacket layer comprising a plastic or similar coating material to complete the torque balanced electromechanical cable. The fourth jacket layer is extruded onto the second armor layer and surrounds the wires and/or strands, filling any void spaces between the wires and/or strands of the second armor layer.

Other aspects and advantages of the present invention will be apparent from the following detailed description of the preferred embodiments and the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
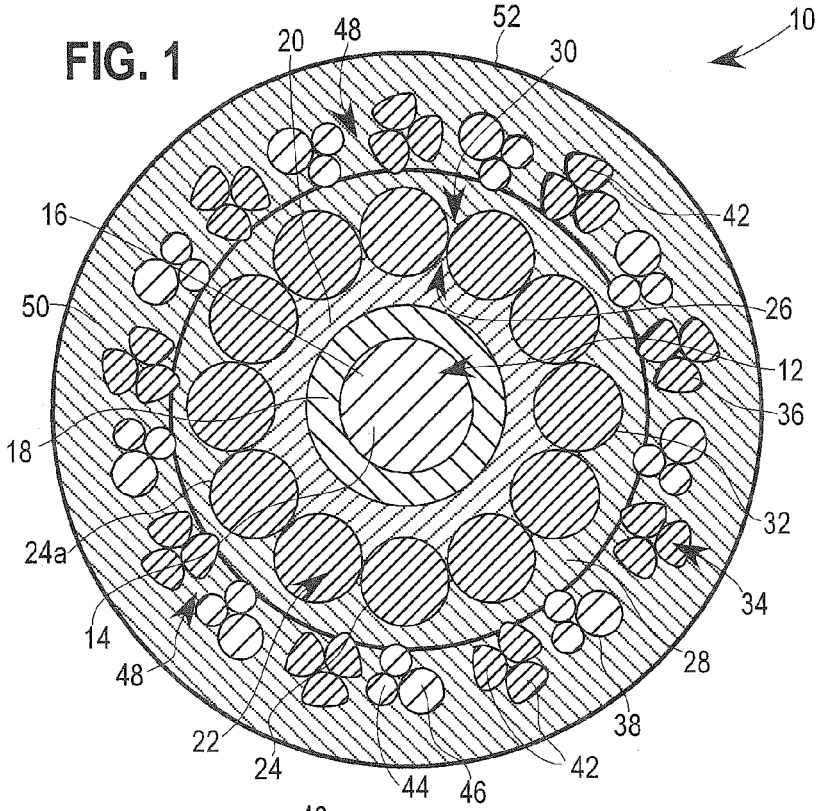
FIG. 1 is a schematic sectional view of an electromechanical cable having an armor layer with alternating symmetric and asymmetric 3-wire strands in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 2:
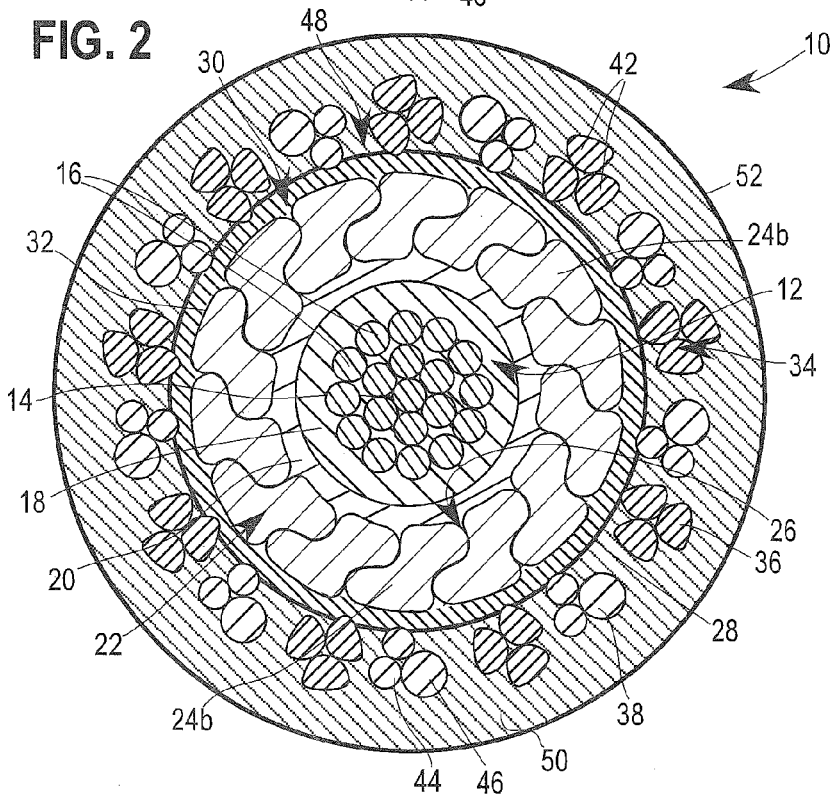
FIG. 2 is a schematic sectional view of an electromechanical cable having an armor layer with Z-shaped wires in accordance with another embodiment of the present invention.
Figure 6:
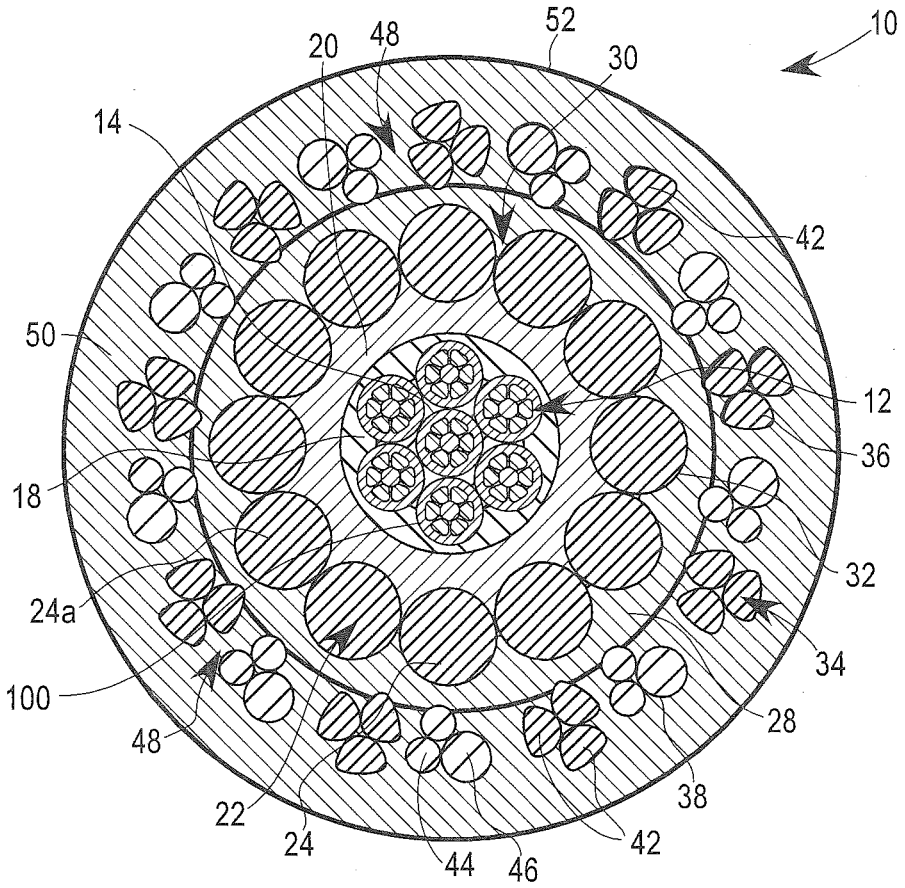
FIG. 6 is a schematic sectional view of an electromechanical cable having an alternative cable core design in accordance with another embodiment of the present invention.
Figure 6A:
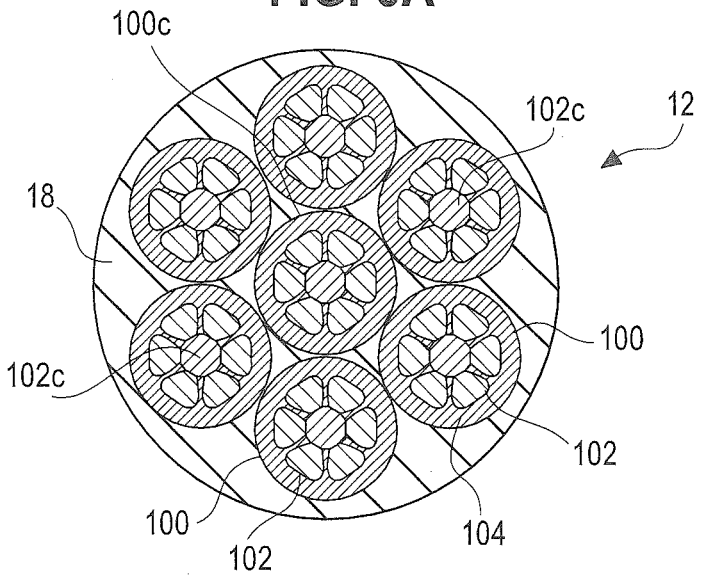
FIG. 6A is a schematic sectional view of the electromechanical cable of FIG. 6 illustrating the cable core.

The present invention is generally directed toward a torque-balanced electromechanical cable 10 as illustrated in various embodiments throughout the figures. Electromechanical cable 10 can comprise a cable core 12 and one or more jacket layers and/or armor layers as described in greater detail below. As shown in FIG. 1, cable core 12 can include a core conductor 14, comprising at least one conductor wire 16, and a first jacket layer 18. As shown in FIG. 1, core conductor 14 comprises a single conductor wire 16. Alternatively, as shown in FIG. 2, core conductor 14 comprises a plurality of conductor wires 16. In yet another alternative embodiment, cable core 12 can include multiple core conductors 14, as shown in FIGS. 6 and 6A, each comprising at least one conductor wire 16, as described in greater detail below. Conductor 14 can also be a fiber in metallic tube ("FIMT"), a copper conductor or other suitable conductor for signal and/or power transmission. The diameter of conductor 14 can vary depending on the desired application of electromechanical cable 10. In the embodiment shown in FIG. 4, conductor wires 16 each have an approximate diameter of 0.0142 inches (0.0361 cm) as commonly used in the art, such that conductor 14 has a diameter of approximately 0.071 inches (0.180 cm). However, larger and smaller diameters for conductor wires 16 and conductors 14 are considered within the scope of the present invention.

As shown in FIG. 6A, conductor core 12 can have a plurality of conductors 100. Each conductor 100 comprises a plurality of wires 102 with conductive properties, such as copper wires, surrounded by an insulator jacket 104. Insulator jacket 104 can be constructed from a number of different materials or combinations of materials, including but not limited to ethylene tetrafluoroethylene ("ETFE"), polytetrafluoroethylene ("PTFE"), ePTFE tape produced by Gore®, perfluoroalkoxyalkane ("PFA"), fluorinated ethylene propylene ("FEP"), or any insulating material now known or hereafter developed. In the embodiment illustrated in FIGS. 6 and 6A, each conductor 100 comprises seven (7) wires 102 and wherein six (6) wires 102 are wrapped around a center wire 102*c*. Each conductor 100 can also be compacted in a manner similar to that described below with reference to FIG. 7A. Plurality of conductors 100 can be oriented within conductor core 12. In such an embodiment, six (6) conductors 100 are helically wrapped around center conductor 100*c*. However, a person of skill in the art will appreciate that other common numbers of plurality conductors 100 may be used. Conductor core 12 often includes the number of conductors in a range from 1-10 depending upon the down-hole requirements and overall diameter of the cable needed. However, any number of conductors is within the scope of the present invention.

Figure 7:
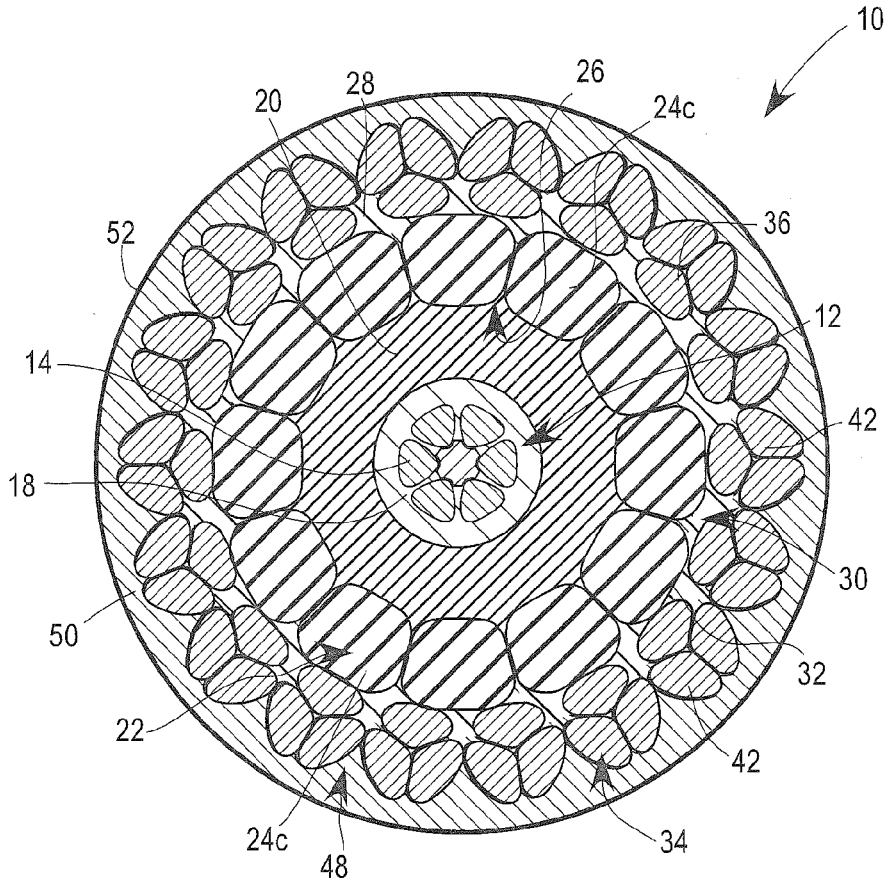
FIG. 7 is a schematic sectional view of an electromechanical cable having an alternative embodiment in accordance with another embodiment of the present invention.
Figure 7A:
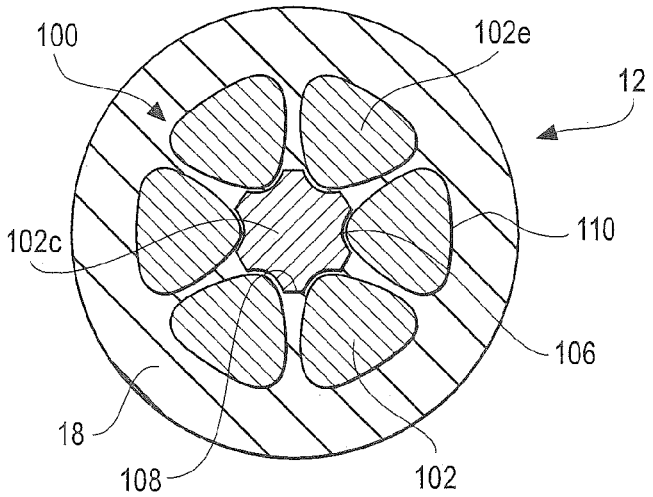
FIG. 7A is a schematic sectional view of the electromechanical cable of FIG. 7 illustrating the cable core.

As shown in FIGS. 7 and 7A, conductor core 12 can comprise a single conductor 100 with a plurality of wires 102 where conductor 100 is compacted prior to application of an insulator jacket 104. Conductor 100 can be compacted to smooth or flatten the outer surface of plurality of wires 102. As shown in FIG. 7A, the compaction step significantly deforms the cross-section of the originally round plurality of wires 102 into a generally "D" or triangular shape wherein each exterior wire 102*e* has a rounded exterior face 110. Compaction reduces the voids between wires 102 thereby creating a more dense distribution of wires in conductor 100. As further shown in FIG. 7A, compaction of wires 102 may significantly indent a portion 106 of an outer surface 108 of center wire 102*c*. After plurality of wires 102 are compacted, insulator jacket 104 can be applied to encapsulate plurality of wires 102 by co-extruding insulator jacket 104 over plurality of wires 102.

Cable core 12 can also include a first jacket layer 18 surrounding conductor 14. First jacket layer 18 comprises any jacketing or coating material commonly used in commercial wire or wire rope. In the embodiment shown in FIG. 1, first jacket layer 18 is constructed from FEP. In alternative embodiments, first jacket layer 18 can be constructed from other polymers such as ETFE, PFA polymers, polyvinylidene fluoride ("PVDF"), perfluoromethoxy polymers, and any mixture thereof.

The thickness of the first jacket layer 18 can vary depending on the desired application of electromechanical cable 10. In the embodiments shown in the figures, first jacket layer 18 has a thickness range approximately between 0.005 inches and 0.035 inches (0.013 cm-0.089 cm). However, thicknesses outside this range are within the scope of the present invention.

First jacket layer 18 surrounds conductor 14 to form cable core 12. First jacket layer 18 can be applied to conductor 14 by extrusion or any other jacketing method commonly used in the art. Such methods can include, but are not limited to, taping, volcanizing, ram extrusion and the like. The overall diameter of cable core 12 depends on the diameter of conductor 14 and the thickness of first jacket layer 18. In the embodiment shown in FIG. 1, cable core 12 has a diameter of approximately 0.098 inches (0.249 cm); however, the diameter of cable core 12 in alternative embodiments can be any diameter useful in the art.

As shown in FIG. 1, cable core 12 is surrounded by a second jacket layer 20. Second jacket layer 20 can comprise any jacketing or coating material such as FEP, ETFE, PFA, PVDF or any combination thereof In the embodiment shown in FIG. 1, second jacket layer 20 comprises ETFE. Second jacket layer 20 can also include fillers to improve abrasion resistance behavior or electrostatic dissipation reduction as described above.

Second jacket layer 20 can be applied to cable core 12 through extrusion or any other jacketing method known in the art. The thickness of second jacket layer 20 varies depending on the desired application of electromechanical cable 10, and, in the embodiments shown in the figures, second jacket layer 20 has a thickness range approximately between 0.005 and 0.035 inches (0.013 cm-0.089 cm). However, a person of skill in the art will appreciate that the range of sizes, thicknesses, and diameters set forth throughout this disclosure can easily be scaled up or down to result in an electromechanical cable of varying layer thickness and overall sizes as desired or required for certain applications.

Figure 3:
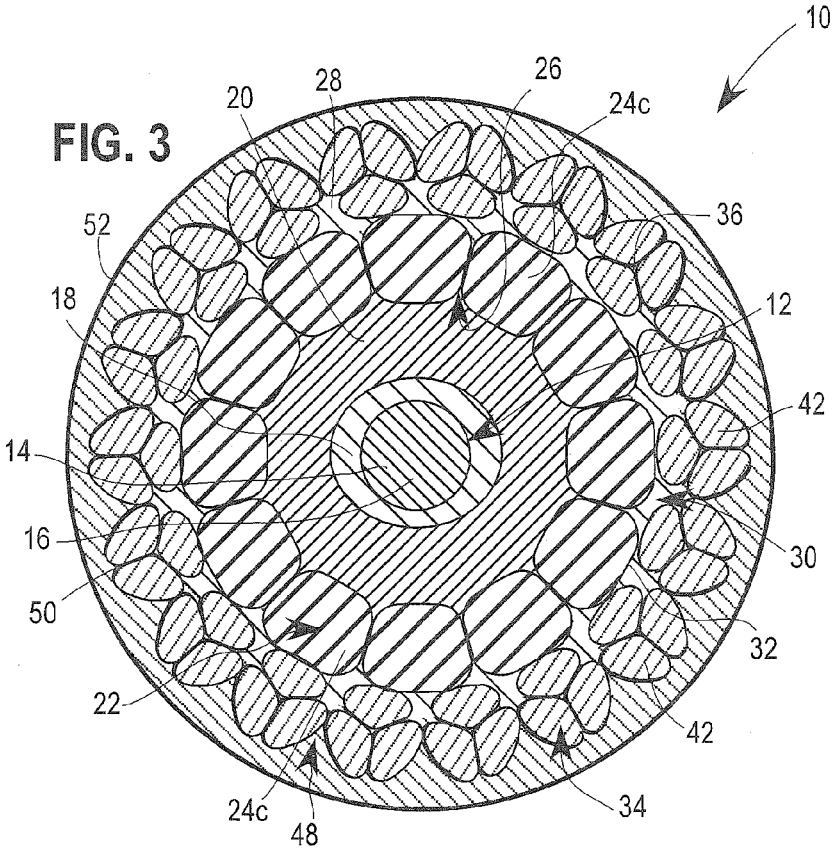
FIG. 3 is a schematic sectional view of an electromechanical cable having an armor layer with trapezoidal-shaped wires in accordance with another embodiment of the present invention.
Figure 8:
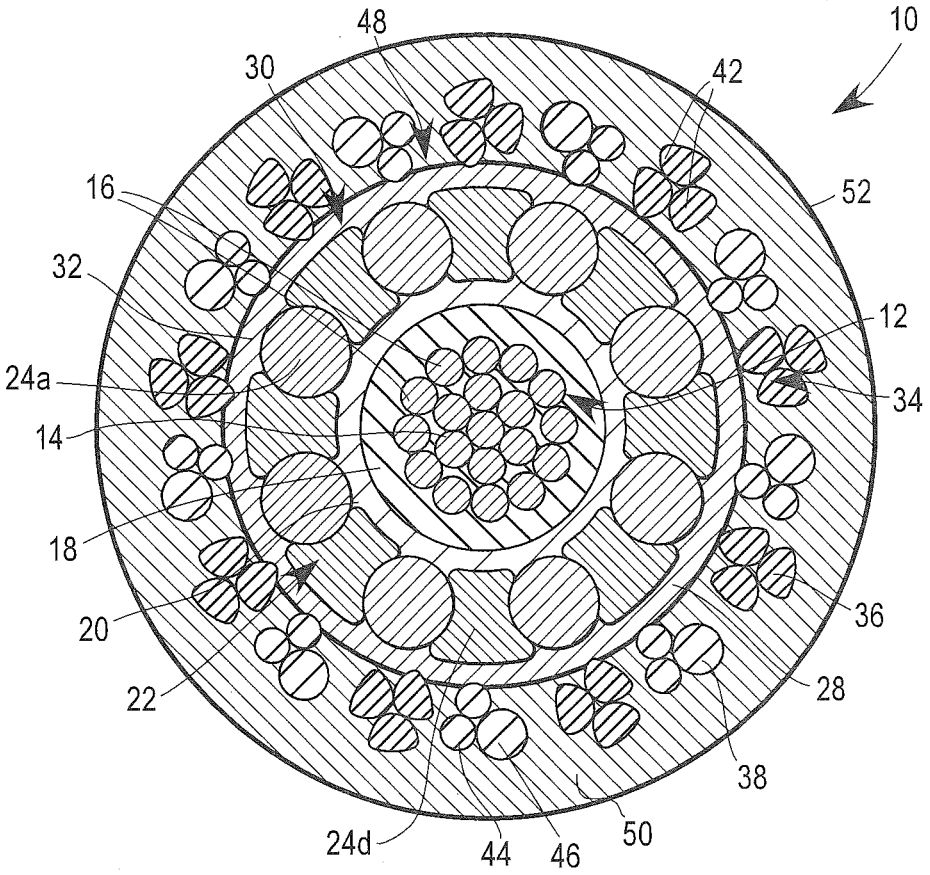
FIG. 8 is a schematic sectional view of an electromechanical cable having an armor layer with H-shaped wires in accordance with another embodiment of the present invention.

As shown in FIG. 1, electromechanical cable 10 can further include a first armor layer 22 surrounding second jacket layer 20 and disposed there-around. First armor layer 22 can comprise a plurality of wires 24 helically wrapped around second jacket layer 20 and cable core 12. Plurality of wires 24 comprising first armor layer 22 can have various shapes and configurations depending on the particular application of electromechanical cable 10. As shown in FIG. 1, in one embodiment, first armor layer 22 comprises a plurality of round wires 24*a*. In another embodiment, as shown in FIG. 2, first armor layer 22 comprises a plurality of Z-shaped wires 24*b*. In yet another embodiment, as shown in FIG. 3, first armor layer 22 comprises a plurality of trapezoidal-shaped wires 24*c*. In yet another embodiment, as shown in FIG. 8, first armor layer 22 comprises a plurality of alternating round wires 24*a* and H-shaped wires 24*d*. Plurality of wires 24 can have any number of additional shapes or combinations of shapes in alternative embodiments of the present invention. Plurality of wires 24 can comprise any wire material or type commonly used in art, including extra high strength ("EHS") wires. The diameter or thickness of each wire 24, and correspondingly the thickness of first armor layer 22, can vary depending on the specific application of electromechanical cable 10. In one embodiment, as shown in FIG. 1, each wire 24 has an approximate diameter of 0.04 inches (0.102 cm).

First armor layer 22 can be wrapped around the second jacket layer 20 in various lay configurations depending on the particular embodiment as described in greater detail below. Once wrapped around the second jacket layer 20, first armor layer 22 can be compressed into second jacket layer 20 such that plurality of wires 24 create indentations in second jacket layer 20 and nest therein, as best shown in FIG. 1. As also shown in FIG. 1, plurality of wires 24 can nest into second jacket layer 20 so that a plurality spaces or voids 26 between each of plurality of wires 24 is substantially filled. The thickness of second jacket layer 20 can be greater than the radius of each of plurality of wires 24*a* or half-depth of each of plurality of wires 24*b* or 24*c* or 24*d* in order to ensure that first armor layer 22 can be sufficiently compressed into second jacket layer 20 to substantially fill plurality of voids 26 between each of plurality of wires 24. The compression of first armor layer 22 into second jacket layer 20 reduces the total diameter of electromechanical cable 10. Plurality of wires 24 can be wound with either a left or a right lay of varying angles. In the embodiment of FIG. 1, plurality of wires 24 of first armor layer 22 are applied in a right lay configuration at a lay of around 1.4 inches (3.6 cm) and a lay angle of around 21.1 degrees; however, other lay configurations, lays, and lay angles can be used. Prior to applying additional layers around first armor layer 22, first armor layer 22 can be cleaned using a plasma cleaning method to improve adhesion of the polymer to the wires.

As further shown in FIG. 1, a third jacket layer 28 can be disposed around first armor layer 22. Third jacket layer 28 can be constructed in a similar manner as first and second jacket layers 18 and 20 and comprise an FEP, ETFE, PFA material or the like. Third jacket layer 28 can also include a filler material and be applied through extrusion or any other jacketing method known in the art as described above. Third jacket layer 26 can fill a plurality of spaces or voids 30 between plurality of wires 24 on an outer surface 32 of first armor layer 22. This can be accomplished during extrusion of third jacket layer 22 and/or by compressing third jacket layer 28 onto plurality of wires 24 of first armor layer 22. This can result in the perimeter of plurality of wires 24 being completely or substantially surrounded by second jacket layer 20 and third jacket layer 28 as shown in FIGS. 1, 4, and 5.

The thickness of the third jacket layer 28 can vary depending on the desired application of the electromechanical cable 10. In the embodiments shown in the figures, third jacket layer 28 has a thickness range approximately between 0.002 and 0.035 inches (0.005 and 0.089 cm); however thicknesses outside this range can also be used depending on the particular embodiment. In one embodiment, as shown in FIG. 1, third jacket layer 28 has a thickness of approximately 0.005 inches (0.0127 cm).

As shown in FIG. 1, a second armor layer 34 can be helically wrapped around and surround third jacket layer 28. Second armor layer 34 can be laid in various configurations similar to first armor layer 22 as described in greater detail below. Second armor layer 34 can be constructed from different types of wires or wire strands, including symmetric 3-wire strands 36 as shown in FIG. 4, a-symmetric 3-wire strands 38 as shown in FIG. 1, single wires 40 as shown in FIG. 5, or any combination thereof. In some embodiments, the 3-wire strands 36 and/or 38 can be compacted, as shown in FIGS. 1 and 3, to change the perimeter shape and cross-section of the strands. Compaction can provide a "rounder" exterior shape of strands 36 and/or 38. Strands 36 and/or 38 and/or wires 40 can have a spaced configuration so there is a void or gap 48 between each of strands 36 and/or 38 and/or wires 40 as shown in FIG. 1. The wires of 3-wire strands 36 and 38 and single wires 40 can comprise any wire or strand material or type known in the industry. The wire or strand material can include steel wires, which can be extra high strength ("EHS"), high-strength steel wires, galvanized steel or stainless steel. Aluminum and synthetic wire as known in the art can also be used. In some embodiments, the wires used within each armor layer can be metallic, synthetic fiber, or combination thereof. In one embodiment, the wires and/or strands used in the present electromechanical cable will generally have a yield strength of around 36 ksi-86 ksi; however, wires having other yield strengths can also be incorporated into the design.

Figure 4:
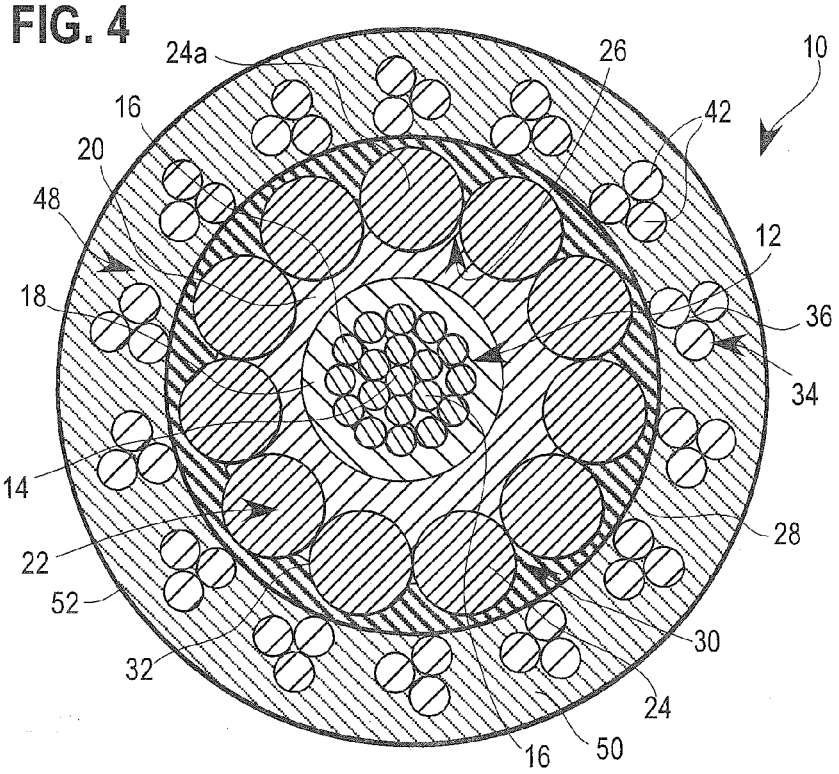
FIG. 4 is schematic sectional view of an electromechanical cable having an armor layer with symmetric 3-wire strands in accordance with another embodiment of the present invention.
Figure 5:
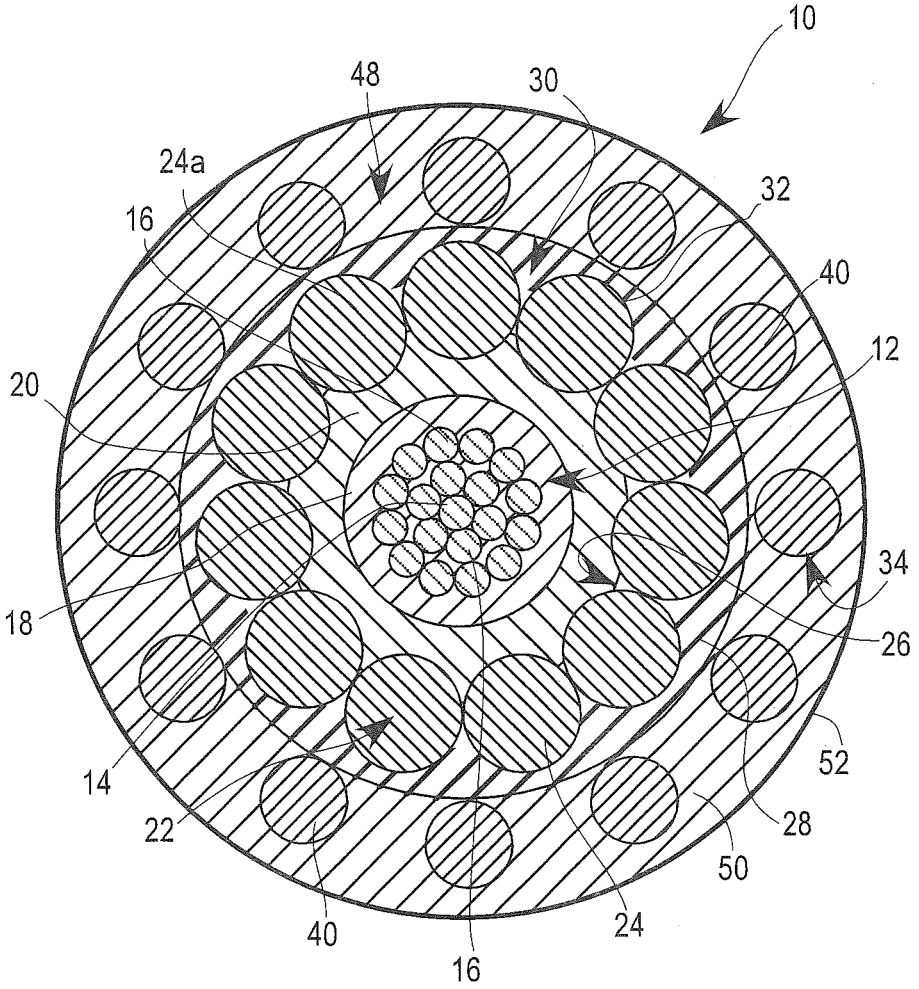
FIG. 5 is a schematic sectional view of an electromechanical cable having an armor layer with single wires in accordance with another embodiment of the present invention.

Symmetric 3-wire strands 36 can consist of three same diameter wires 42, as best shown in FIG. 4. In the embodiment shown in FIG. 4, wires 42 have a diameter of approximately 0.02 inches (0.051 cm), and strands 36 can have an overall diameter of approximately 0.039 inches (0.099 cm). In alternative embodiments, wires 42 can have diameter approximately between 0.01 inches and 0.10 inches (0.025 and 0.254 cm). The diameter can be reduced if 3-wire strands 36 are compacted, as shown in FIG. 3. Larger and smaller diameters for wires 42 and strands 36 can be used depending on the particular application of the present invention. Symmetric 3-wire strands 36 can also be twisted or otherwise formed as known in the art.

Asymmetric 3-wire strands 38 can consist of two same diameter wires 44 and one larger diameter wire 46, as best shown in FIG. 1. Larger diameter wire 46 can have a diameter approximately between 0.01 inches and 0.20 inches (0.025 and 0.051 cm), and smaller diameter wires 44 can have a diameter approximately between 0.005 inches and 0.10 inches (0.013 and 0.254 cm), depending on the particular embodiment of the present invention. Wires 44 and 46 can be constructed with various other diameters; however diameter of wire 46 should be greater than the diameter of wires 44 at a ratio of approximately 1.25 to 10, and in specific embodiments, approximately 1.333 to 3. Similar to wires 42 of symmetric 3-wire strands 36, asymmetric 3-wire strands 38 can be twisted or otherwise formed as known in the art.

Single wires 40 can also be used in second armor layer 34 as shown in FIG. 5. Single wires 40 can be constructed from steel, aluminum or other materials commonly used to construct wires, including EHS wires. The diameter of single wires 40, depending on the particular embodiment of the present invention, can have a range approximately between 0.02 inches and 0.05 inches (0.051 and 0.127 cm); however the diameter can be larger or smaller depending on the desired application of electromechanical cable 10. In the embodiment shown in FIG. 5, single wires 40 have a diameter of approximately 0.035 inches (0.889 cm).

Second armor layer 34 can be wound in a right lay or left lay depending on the particular embodiment of the present invention. In one embodiment, second armor layer 34 is wound with a lay that is opposite of first armor layer 22. The opposing lay directions between first and second armor layers 22 and 34, respectively, can provide greater torque balance in electromechanical cable 10. The lay length of second armor layer 34 can be approximately between 2.5 inches to 2.6 inches (6.35 to 6.60 cm) and the lay angle can be approximately between 18.2 degrees and 18.4 degrees depending on the particular embodiment; however, larger or smaller lay lengths and lay angles can be used in alternative embodiments. Second armor layer 34 can also have a helix height approximately between 0.207 inches to 0.234 inches (0.526 to 0.594 cm, or 70 to 75 percent) and a helix height approximately between 2.45 inches to 2.55 inches (0.622 to 0.648 cm) depending on the particular embodiment of the present invention.

Second armor layer 34 can be compressed into third jacket layer 28 once wrapping is complete in a manner similar to first armor layer 22. After application of second armor layer 34, the outer diameter of the partially assembled present electromechanical cable 10 can be approximately between 0.295-0.316 inches (0.749-0.803 cm), depending on the specific embodiment. However, as noted above, a person of skill in the art will appreciate that scaled variations are within the scope of the present invention. Second armor layer 34 can also be plasma cleaned to improve plastic adhesion.

As shown in FIG. 1, fourth jacket layer 50 can surround second armor layer 34. Fourth jacket layer 50 can be applied through extrusion or any other jacketing method known in the art. In one embodiment, fourth jacket layer 50 is constructed from ETFE. Fourth jacket layer 50 can penetrate into a plurality gaps 48 between strands 36 and/or 38 and/or single wires 40 so as to substantially surround strands and/or wires 36, 38, and/or 40. Fourth jacket layer 50 can also include a smooth outer surface 52. Accordingly, in one embodiment, the thickness of fourth jacket layer 50 should cover the entirety of second armor layer 34.

In the embodiment shown in FIG. 1, the thickness of fourth jacket layer 50 can be around 0.02-0.10 inches (0.0508-0.254 cm). However, fourth jacket layer 40 can be of other thicknesses in a range from 0.01 to 0.5 inches (0.0254 to 1.27 cm). The outer diameter of the completed present torque balanced electromechanical cable 10 after the application of fourth jacket layer 40 can be approximately around 0.333-0.365 inches (0.846-0.927 cm), depending on the particular embodiment of the present invention. However, as noted above, a person of skill in the art will appreciate that scaled variations are within the scope of the present invention and other final diameters are within the scope of the present invention. In particular, the present torque balanced electromechanical cable 10 can be configured to have a final outer diameter in a range between one-eighth inch and five inches (0.318 and 12.700 cm).

The configuration of the various embodiments of electromechanical cable 10 and the lay orientations of the first and second armor layers 22 and 34 create a "torque-balancing" effect in electromechanical cable 10. Theoretical torque-balance between first armor layer 22 and second armor layer 24 is achieved by a torque ratio equal to 1. Accordingly, the embodiments of the present invention are aimed at achieving a torque ratio approximate to 1.0. The embodiment shown in FIG. 1 has a torque ratio equal to 1.36. The embodiment shown in FIG. 2 has a torque ratio equal to 1.01. The embodiment shown in FIG. 3 has a torque ratio equal to 1.18. The embodiment shown in FIG. 4 has a torque ratio equal to 1.009. Finally, the embodiment shown in FIG. 5 has a torque ratio equal to 0.94.

The following non-limiting examples, with specific reference to FIGS. 1, 4, and 5 describe specific particular embodiments of electromechanical cable 10; however, alternative embodiments or combination of these specific embodiments are within the scope of the present invention.

FIG. 1 shows one specific embodiment of the present invention where second armor layer 34 comprises alternating symmetric 3-wire strands 36 and asymmetric 3-wire strands 38. Core conductor 14 within cable core 12 comprises nineteen (19) copper conductor wires 16 of a diameter of approximately 0.0142 inches (0.036 cm). First jacket layer 18 is a fluorinated ethylene propylene (FEP) jacket. The total diameter of cable core 12 is approximately 0.098 inches (0.249 cm). Extruded onto cable core 12 is second jacket layer 20 having a thickness of approximately 0.019 inches (0.048 cm) and consisting of ethylene tetrafluoroethylene (ETFE). The outer diameter of cable 10 after application of second jacket layer 20 is approximately 0.136 inches (0.345 cm). Wrapped around second jacket layer 20 is first armor layer 22. First armor layer 22 comprises a plurality of wires 24, which consists of 12 round wires 24*a*. Wires 24*a* are EHS wires with a diameter of approximately 0.04 inches (0.102 cm). First armor layer 22 is helically wound with a right lay configuration at a lay of approximately 1.4 inches (3.5 cm) and lay angle of approximately 21.1 degrees. First armor layer 22 is also "pressed" into second jacket layer 20 causing round wires 24*a* to indent into second jacket layer 20 thereby completely filling plurality of voids 26 between wires 24*a*. Extruded onto first armor layer 22 is third jacket layer 28, which is an ETFE jacket having a thickness of approximately 0.005 inches (0.0127 cm). Third jacket layer 28 completely fills plurality of voids 30 within first armor layer 22. After application of third jacket layer 28, the outer diameter of electromechanical cable 10 is approximately 0.226 inches (0.574 cm).

Wrapped around third jacket layer 28 is second armor layer 34, which comprises nine compacted symmetric 3-wire strands 36 and nine non-compacted asymmetric 3-wire strands 38 configured in an alternating fashion. Strands 36 and 38 have an overall dimension of approximately 0.039 inches (0.099 cm) and are constructed from EHS wires. Second armor layer 34 is helically wound in a left lay (opposite of first armor layer 22), with the lay being approximately 2.6 inches (6.6 cm) and the lay angle being approximately 18.38 degrees. The helix height is around 0.22-0.236 inches (0.56-0.60 cm) and the helix length is around 2.55-2.6 inches (6.48-6.60 cm). Once second armor layer 34 is wrapped, it is compressed into third jacket layer 28. Extruded onto second armor layer 34 is fourth jacket layer 50, which consists of an ETFE jacket having a thickness of 0.02 inches (0.0508 cm). The lays of the first and second armor layers 22 and 34 provide a torque ratio approximately equal to 1.36.

FIG. 4 shows one specific embodiment of the present invention where second armor layer 34 comprises symmetric 3-wire strands 36. Cable core 12 comprises a copper core conductor 14 and an FEP extruded first jacket layer 18. Core conductor 14 consists of nineteen 0.0142 inch (0.036 cm) diameter copper wires. Extruded onto conductor core 14 is second jacket layer 20 comprising ETFE and having a thickness of approximately 0.019 inches (0.048 cm). First armor layer 22 is helically wrapped around second jacket layer 20 and comprises eleven EHS wires 24*a*, defining plurality of wires 24. Each wire 24*a* has a diameter of approximately 0.047 inches (0.119 cm). The clearance between wires 24*a* is approximately 2.3 percent. Wires 24*a* are wound in a right lay direction of approximately 1.7 inches with a lay angle of approximately 18.3 degrees. First jacket layer 22 is pressed into second jacket layer 20 after wrapping such that plurality of inner void spaces 26 between wires 24*a* are completely filled by second jacket layer 20. A third thin plastic jacket layer 28 is extruded around first armor layer 22. Third jacket layer 28 has a thickness of approximately 0.004 inches (0.0102 cm) and completely fills plurality of outer void spaces 30 created by wires 24*a* of first armor layer 22.

A second armor layer 34 is wrapped around third jacket layer 28. Second armor layer 34 comprises fourteen non-compacted symmetric 3-wire strands 36 having a strand diameter approximately equal to 0.043 inches (0.109 cm). Each wire in 3-wire strands 36 are EHS wires with a diameter approximately equal to 0.020 inches (0.051 cm). Three-wire strands 36 are formed with a right lay direction with a 0.3 inch (0.762 cm) lay and 13.5 degree lay angle. Once each 3-wire strand 36 is formed, second armor layer 34 is wrapped around third jacket layer 28 in a left lay direction with a lay length of approximately 2.55 inches (6.48 cm) and a lay angle of approximately 18.3 degrees. The helix height is around 0.218-0.234 inches (0.554-0.594 cm) and the helix length is around 2.50-2.55 inches (6.35-6.48 cm). The clearance between strands 36 is approximately 35%. Extruded around second armor layer 34 is fourth jacket layer 50 completely filling plurality of void spaces 48 created around the exterior of 3-wire strands 36. Fourth jacket layer 50 is an ETFE jacket with a thickness approximately equal to 0.02 inches (0.051 cm). The final diameter of electromechanical cable 10 is around 0.349-0.355 inches (0.886-0.902 cm) and has a torque ratio approximately equal to 1.009.

FIG. 5 shows one specific embodiment of the present invention where second armor layer 34 comprises single wires 40. The cable core 12, second jacket layer 20, first armor layer 22, and third jacket layer 28 are constructed identical to cable core 12, second jacket layer 20, first armor layer 22, and third jacket layer 28 of the previously described embodiment. Contrary to the previously described embodiment, second armor layer 34 in the present embodiment comprises twelve single EHS wires 40, each with a diameter approximately equal to 0.035 inches (0.089 cm). Second armor layer 34 is helically wrapped around third jacket layer 28 in a left lay direction with a lay length of approximately 2.50 inches (6.35 cm) and a lay angle of approximately 18.2 degrees. The helix height is approximately 0.207-0.222 inches (0.526-0.564 cm) and the helix length is approximately 2.45-2.50 inches (6.22-6.35 cm). A fourth ETFE jacket layer 50 with a 0.020 inch-thickness (0.051 cm) is extruded onto second armor layer 34 to complete the construction of electromechanical cable 10. Fourth jacket layer 50 fills plurality of void spaces 48 created by wires 40 of second armor layer 34. The final diameter of electromechanical cable 10 is approximately 0.333-0.339 inches (0.846-0.861 cm) and the torque ratio is approximately 0.94.

The configuration of second armor layer 34 results in a substantial improvement in the mechanical adhesion between second armor layer 34 and fourth jacket layer 50. This increase in adhesion can be a result of increased penetration of fourth jacket layer 50 into plurality voids or spaces 48 of second armor layer 34. Additionally, the size of the helical channels and grooves created using symmetrical strands 36, asymmetrical strands 38, and/or single wires 40. This adhesion can be improved by configuring second armor layer 34 with alternating 3-wire strands 36, 38 and/or single wires 40 as shown in FIG. 1.

The induced torque of the present torque balanced electromechanical cable 10 can be minimized by balancing the amount of the torque in first armor layer 22 and second armor layer 34. Torque balancing can also be achieved through the one or more second, third, and fourth jacket layers 20, 28, and 50, respectively, locking the location of the wires of first and second armor layers 22 and 34 respectively, in place and/or filling the plurality of voids and grooves in the wire strands. In one embodiment, fourth jacket layer 50 has more impact on the torque-resistance than the other jacket layers. As such, the present torque balanced electromechanical cable 10 experiences a reduced tendency of the cable to rotate when axially tensioned.

Additionally, when all of the voids, grooves and spaces between the wires are filled with the jacket layers, the electromechanical cable can be crush-resistant. This feature is particularly important when FIMT is included in cable core 12 to allow for better data transfer and maintained data transfer while the present cable is in use.

From the foregoing, it will be seen that this invention is one well adapted to attain all the ends and objects hereinabove set forth together with other advantages which are obvious and which are inherent to the structure. It will be understood that certain features and sub combinations are of utility and can be employed without reference to other features and sub combinations. This is contemplated by and is within the scope of the claims. Since many possible embodiments of the invention can be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. An electromechanical cable comprising:

a core comprising at least one conductor and a first jacket layer surrounding said at least one conductor;

a second jacket layer surrounding said core;

a first armor layer surrounding said second jacket layer, said first armor layer comprising a plurality of wires wrapped around said second jacket layer and compressed to indent said second jacket layer;

a third jacket layer surrounding said first armor layer, said third jacket layer substantially surrounding said wires of said first armor layer;

a second armor layer surrounding said third jacket layer, said second armor layer comprising a plurality of 3-wire strands wrapped around said third jacket layer, and wherein said plurality of 3-wire strands comprises symmetrical 3-wire strands and asymmetrical 3-wire strands alternatively arranged; and a fourth jacket layer surrounding said second armor layer.

2. The electromechanical cable of claim 1 wherein at least one of said plurality of 3-wire strands is compacted.

3. The electromechanical cable of claim 1 wherein said asymmetrical 3-wire strands comprise two wires having a first diameter and one wire comprising second diameter, wherein said first diameter is less than said second diameter.

4. The electromechanical cable of claim 1 wherein said first armor layer is wrapped around said second jacket layer with a first lay direction and said second armor layer is wrapped around said third jacket layer with a second lay direction, and wherein said first lay direction is opposite said second lay direction.

5. The electromechanical cable of claim 1 wherein said first armor layer comprises round wires.

6. The electromechanical cable of claim 1 wherein said first armor layer comprises trapezoid-shaped wires.

7. The electromechanical cable of claim 1 wherein said first armor layer comprises Z-shaped wires.

8. The electromechanical cable of claim 1 wherein said first armor layer comprises H-shaped wires.

9. An electromechanical cable comprising:

a core conductor comprising a plurality of conductor wires;

a first jacket layer surrounding said core conductor;

a second jacket layer surrounding said first jacket layer;

a first armor layer comprising a plurality of wires wrapped around said second jacket layer with a first lay direction and compressed to indent said second jacket layer;

a third jacket layer surrounding said first armor layer;

a second armor layer comprising a plurality of wires wrapped around said third jacket layer with a second lay direction and compressed to indent said second jacket layer, said second armor layer comprises a plurality of symmetrical 3-wire strands and a plurality of asymmetrical 3-wire strands alternatively arranged; and a fourth jacket layer surrounding said second armor layer, said fourth jacket layer having a smooth outer surface;

wherein said first lay direction is opposite said second lay direction.

10. The electromechanical cable of claim 9 wherein said asymmetrical 3-wire strands comprise two wires having a first diameter and one wire comprising second diameter, wherein said first diameter is less than said second diameter.

* * * * *